US007540277B2

(12) United States Patent
Hedlund

(10) Patent No.: US 7,540,277 B2
(45) Date of Patent: Jun. 2, 2009

(54) FUEL SYSTEM FOR A VIBRATORY RAMMER

(75) Inventor: Gunnar Hedlund, Karlskrona (SE)

(73) Assignee: Dynapac Compaction Equipment AB, Karlskrona (SE)

( * ) Notice: Subject to any disclaimer, the term of this patent is extended or adjusted under 35 U.S.C. 154(b) by 0 days.

(21) Appl. No.: 11/700,030

(22) Filed: Jan. 31, 2007

(65) Prior Publication Data

US 2007/0193566 A1 Aug. 23, 2007

(30) Foreign Application Priority Data

Feb. 17, 2006 (SE) ..... 0600347

(51) Int. Cl.
*F02M 33/00* (2006.01)
*F02M 37/00* (2006.01)
*F02M 5/00* (2006.01)

(52) U.S. Cl. ..... 123/518; 123/516; 123/530

(58) Field of Classification Search ..... 123/46 R, 123/46 H, 514, 516, 518, 530; 137/255, 137/256; 173/90, 206, 209; 180/314; 404/133.01, 404/133.05; 405/271
See application file for complete search history.

(56) References Cited

U.S. PATENT DOCUMENTS

| | | | | |
|---|---|---|---|---|
| 4,905,641 | A | 3/1990 | Miller | |
| 6,419,420 | B2 | 7/2002 | Hedlund | |
| 6,874,482 | B2 | 4/2005 | Lahner et al. | |
| 2004/0163631 | A1 * | 8/2004 | Leini et al. | 123/510 |
| 2004/0221836 | A1 * | 11/2004 | Lahner et al. | 123/510 |
| 2005/0022869 | A1 * | 2/2005 | Beyer et al. | 137/202 |
| 2006/0191578 | A1 * | 8/2006 | Treudt et al. | 137/587 |

FOREIGN PATENT DOCUMENTS

WO WO 02/090752 A1 * 11/2002

* cited by examiner

*Primary Examiner*—Michael Cuff
*Assistant Examiner*—Ka Chun Leung
(74) *Attorney, Agent, or Firm*—Walter Ottesen

(57) ABSTRACT

A fuel system (1) for a vibratory rammer (2) includes a tank arrangement (3), a diaphragm carburetor (4), a fuel line arrangement (5) and a venting line arrangement (6) for complementary venting of air from the fuel system (1) to the atmosphere. The fuel system (1) also includes a venting valve (7) which is open and closeable to the atmosphere. The tank arrangement (3) includes a primary fuel tank (8) and a secondary fuel tank (11).

8 Claims, 3 Drawing Sheets

FUEL SYSTEM FOR A VIBRATORY RAMMER

CROSS REFERENCE TO RELATED APPLICATION

This application claims priority of Swedish patent application no. 0600347-9, filed Feb. 17, 2006, the entire content of which is incorporated herein by reference.

FIELD OF THE INVENTION

The invention relates to a fuel system for a vibratory rammer with complementary venting of the system after refueling. The fuel system comprises a tank arrangement, fuel line arrangement, venting line arrangement and a diaphragm carburetor. The fuel system of the invention is especially suitable in operational circumstances that may lead to the vibratory rammer being operated until fuel in the tank runs out and the rammer stops for this reason.

BACKGROUND OF THE INVENTION

It is known that the use of diaphragm carburetors can result in problems with regard to the evacuation or venting of air from fuel lines. The problem on vibratory rammers occurs when the machine is operated until the fuel runs out completely and is then refueled. The small difference in height between the fuel tank and the diaphragm carburetor causes air to be trapped inside the fuel lines with little chance of rising and being evacuated via normal venting of the fuel tank. The air trapped inside prevents fuel from reaching the diaphragm carburetor. The vibratory rammer may therefore be extremely difficult to start and requires an unacceptable number of attempts before the machine actually starts.

FIG. 7 of U.S. Pat. No. 6,874,482 shows how a fuel system is provided with complementary venting. A venting line for air extends from a branch connection on the fuel line, just before the diaphragm carburetor, and continues on to the fuel tank. The routing of the venting line continues up to the fuel tank and the venting line exits above the level of the fuel in the tank. In this way, a complementary venting of the fuel system is achieved under favorable conditions. There is, however, considerable risk that small amounts of fuel remaining in the venting line prevent the passage of air through the line. While refueling, there is also the risk of small amounts of fuel being led in the reverse direction in the venting line thus preventing the passage of air through the line.

In U.S. Pat. No. 6,419,420, a completely sealable fuel tank is shown. All tank connections can be closed by valves. The risk of leakage during transportation of the machine is minimized. The tank venting valve and the fuel valve are integrated with the fuel tank and are operable by a coordinated action as shown in U.S. Pat. No. 6,419,420 incorporated herein by reference. Introduction of a venting line for air, as in U.S. Pat. No. 6,874,482, would in itself provide a possibility for some complementary venting but at the same time would require an additional valve integrated with the fuel tank and integration in the coordinated action.

SUMMARY OF THE INVENTION

It is an object of the invention to provide a fuel system facilitating more effective and faster complementary venting than that in earlier known systems. An advantage afforded by the invention is that the machine will be easy to start after refueling. This is achieved in that the fuel system comprises a secondary fuel tank that can be vented. The purpose is also to obtain a fuel system that does not require the connection of venting lines to the primary fuel tank. This is achieved by connecting the venting line to a separate venting valve.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
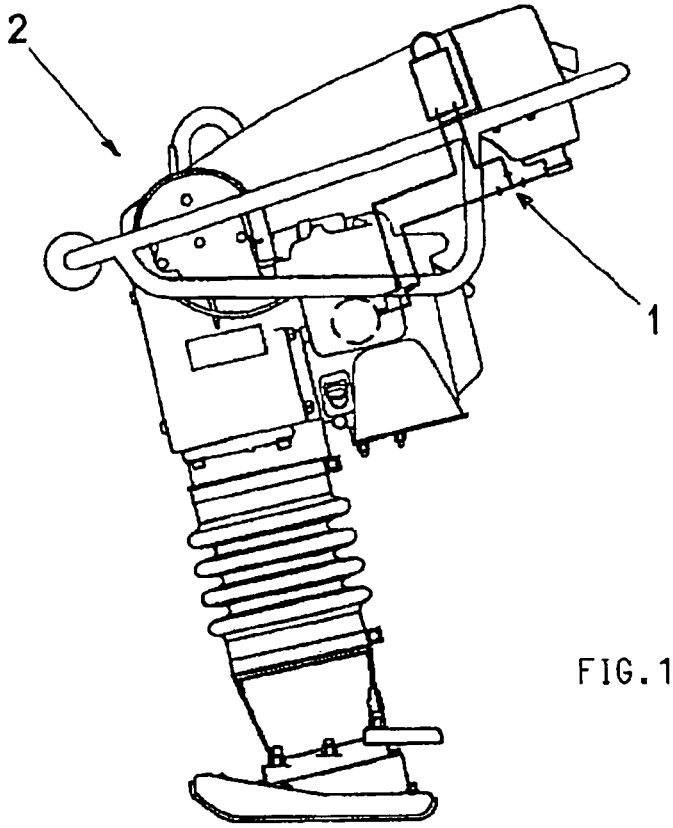
FIG. 1 is a side elevation view of a fuel system according to the invention arranged on a vibratory rammer.

FIG. 1 shows a fuel system 1 arranged on a vibratory rammer 2.

Figure 2:
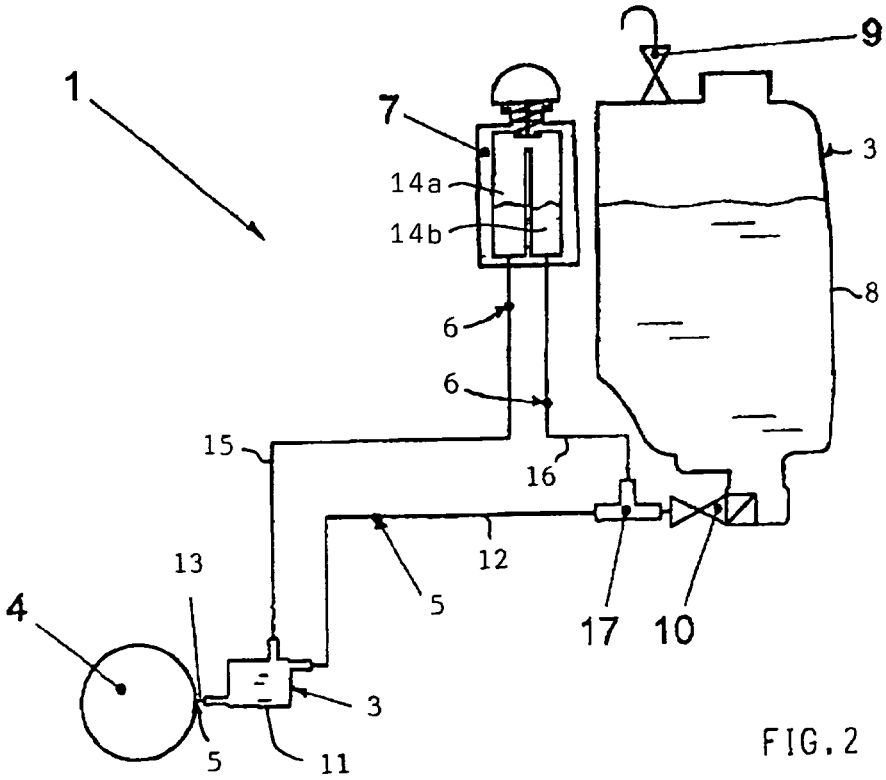
FIG. 2 is a schematic of a first embodiment of the fuel system of the invention.

FIG. 2 shows a preferred first embodiment of the fuel system 1. Fuel system 1 comprises a tank arrangement 3, a diaphragm carburetor 4, a fuel line arrangement 5, a venting line arrangement 6 and a venting valve 7. The diaphragm carburetor 4 is connected to and supplies the internal combustion engine of the vibratory rammer with gasified fuel. The tank arrangement 3 comprises a primary fuel tank 8 placed at a somewhat higher vertical elevation than the diaphragm carburetor 4. An opening for a normal venting arrangement is provided in the upper wall of the primary fuel tank 8 and the venting arrangement comprises an open and closeable tank venting valve 9 and a filter (not shown). The upper wall is also provided with an opening for refueling which is fitted with a tightly sealing filler cap. The base of the primary fuel tank 8 is provided with a fuel connection comprising a fuel filter and an open and closeable fuel valve 10. The primary fuel tank 8 holds 2.5 liters of fuel and is made of polyamide plastic. The tank arrangement 3 also comprises a secondary fuel tank 11 located at a lower vertical elevation than the primary fuel tank 8. A perspective view of the secondary fuel tank 11 is provided in FIG. 4.

The fuel line arrangement 5 comprises a primary fuel line 12 for supplying fuel from the primary fuel tank 8 to the secondary fuel tank 11. The fuel line arrangement 5 also comprises a secondary fuel line 13 for supplying fuel from the secondary fuel tank 11 to the diaphragm carburetor 4. The secondary fuel line 13 should be as short as possible and can be suitably integrated with the secondary fuel tank 11.

The venting valve 7 comprises two chambers (14*a*, 14*b*) that are open and closeable to the atmosphere. The venting valve 7 is designed so that both the chambers (14*a*, 14*b*) are open to the atmosphere when venting valve 7 is actuated by the operator of the vibratory rammer 2 and so that both the chambers (14*a*, 14*b*) are closed to the atmosphere when the venting valve 7 is not actuated. The venting valve 7 is described further with respect to FIG. 3.

The venting line arrangement 6 comprises a primary venting line 16 and a secondary venting line 15. The secondary venting line 15 evacuates air from the secondary fuel tank 11. The air is drawn from the secondary fuel tank to a first chamber 14*a* of the venting valve 7. The primary venting line 16 evacuates air from the primary fuel line 12 to the second chamber 14*b* of the venting valve 7. The air is drawn to the second chamber 14*b* from a branch connector 17 on the primary fuel line 12. The branch connector 17 should be located close to the fuel valve 10.

The fuel and venting lines consist of suitable rubber or plastic hoses with an internal diameter of 5 millimeters. The branch connector 17 consists of a T-pipe with connections adapted to fit hoses. The hoses are arranged with a successive rise to avoid sagging. The material used in the fuel system 1 is resistant to petrol and ethanol.

The fuel system 1 is shown in a state wherein the operator of the vibratory rammer 2 has just refueled because the machine stopped due to lack of fuel. The operator has also made certain that the tank venting valve 9 and the fuel valve 10 are open and has then performed a complementary venting of the fuel system 1 by actuating the venting valve 7 for the necessary length of time. The necessary length of time is about 2 to 10 seconds and depends on how much fuel has been filled but also on dimensions of the lines, lengths of the lines, vertical elevations and volume of the secondary fuel tank 11. During the initial part of a complementary venting, the air is vented first from the filter (not shown) of the primary fuel tank 8 and from the fuel valve 10. The venting is made mainly via the branch connector 17 and the primary venting line 16. All air will not be evacuated this way and will, to some extent, follow the further flow of fuel down to the secondary fuel tank 11 via the primary fuel line 12. When the mixture of air and fuel reaches the secondary fuel tank 11, the air will be separated from the fuel and evacuated via the secondary venting line 15. When the secondary fuel tank 11 is filled, the fuel will flow in and rise in the secondary venting line 15. During the evacuation of air, the fuel will also flow in and rise in the primary venting line 16. When the fuel reaches chambers (14*a*, 14*b*) of the venting valve 7, the fuel level will rise in the chambers (14*a*, 14*b*) to the same level as in the primary fuel tank 8. The fuel system 1 is thus completely vented and fuel is available at the fuel connection point of the diaphragm carburetor 4.

Overpressure can build up in primary fuel tank 8 if it is kept closed for a longer period of time. It is very important that pressure in the tank be equalized before opening the fuel valve 10. Otherwise, there is a risk that fuel will leak from the venting valve 7 if it is actuated by the operator. It is therefore advantageous to coordinate operation of the tank venting valve 9 and the fuel valve 10. The coordination is achieved with a lever so that the tank venting valve 9 opens partially or fully before the fuel valve 10 begins to open. It is therefore advantageous to coordinate operation of the tank venting valve 9 and the fuel valve 10 as described in detail in U.S. Pat. No. 6,419,420 incorporated herein by reference.

Figure 3:
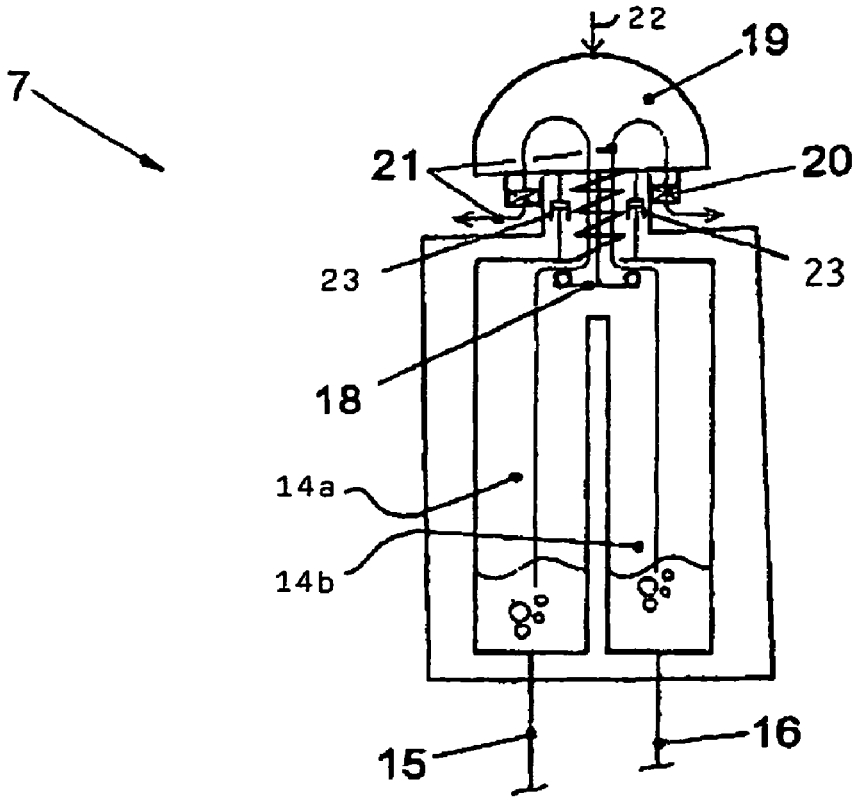
FIG. 3 is a schematic of a venting valve of the fuel system.

FIG. 3 shows the venting valve 7 from FIG. 2 in an enlarged view. The venting valve 7 comprises two chambers (14*a*, 14*b*), a valve 18, a push button 19 and a filter 20. The venting valve 7 is shown in an operator-actuated mode wherein both the chambers (14*a*, 14*b*) are opened to the atmosphere. The operator has actuated the venting valve 7 by pressing the push button 19 as indicated by arrow 22 and, this, in turn, causes the valve 18 to open. Air 21 can thus be evacuated from the chambers (14*a*, 14*b*) to the atmosphere via the filter 20. The filter 20 is located in the passage of the venting valve 7 to the atmosphere and prevents contamination of the fuel system 1 via the venting valve 7.

The two chambers (14*a*, 14*b*) are connected at the bottom to the venting lines (15, 16), respectively. Each chamber (14*a*, 14*b*) should have a cross-sectional area that is significantly greater than the cross-sectional area of the line. It is suitable to provide a cross-sectional area at least four times greater than the cross-sectional area of the line. The fuel that flows into the chambers during the complementary venting may contain residual traces of air. Residual air can cover the entire flow area in the lines. When the flowing fuel experiences an increase in area, the residual air will no longer be able to cover the entire flow area but will be separated into smaller bubbles that flow with ease to the surface of the fuel. The bottom of the chambers (14*a*, 14*b*) are at a vertical level or elevation that always allows remaining air to rise in the venting lines (15, 16) and reach the chambers (14*a*, 14*b*), respectively. The level shall be adapted so that it permits venting after refueling a minimal amount of fuel. The two chambers (14*a*, 14*b*) are joined together at the top. They are, however, separate up to a vertical level that exceeds the maximal fuel level in the primary fuel tank 8. In this way, venting from both the venting lines (15, 16) can be made independently of one another and thus faster.

The valve head of valve 18 closes or opens both chambers (14*a*, 14*b*) to the atmosphere. Spring action is arranged so that the valve 18 is closed when the venting valve 7 is not actuated. In the closed mode, the valve head is sealed by an O-ring. The stem of the valve head is connected to the push button 19. It is possible to use other types of valves that have an equivalent function. It is also possible to complement the spring action with a damping device 23 that delays closing of the valve. In this way, it is ensured that the complementary venting is made during the necessary time duration.

The venting valve 7 should be arranged on the vibratory rammer 2 so that the push button 19 is given a recessed or protected position. This will avoid the situation wherein the venting valve 7 is opened unintentionally during transportation of the machine. The venting valve 7 is made of the plastic material PVDF. It can also be made from other suitable plastic materials, such as polyamide.

Figure 4:
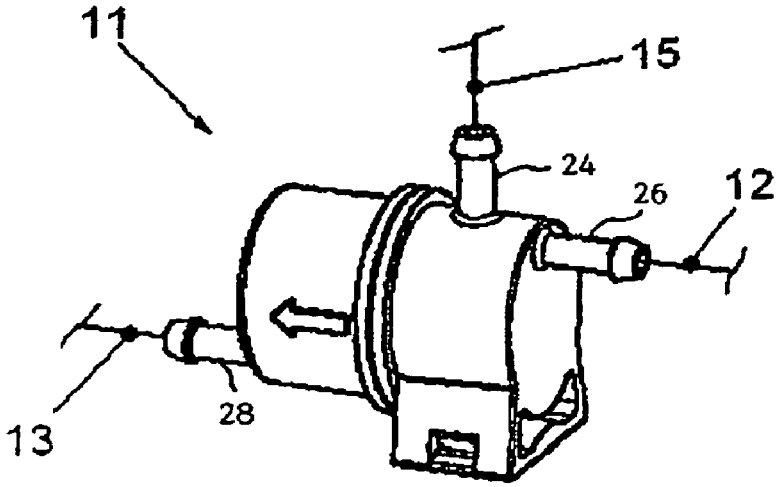
FIG. 4 is a perspective view of a secondary fuel tank.

FIG. 4 shows the secondary fuel tank 11 in an enlarged perspective view. The secondary fuel tank 11 is arranged on the vibratory rammer 2 so that the connection 24 for the secondary venting line 15 is directed upwardly in a vertical direction. The connection 24 is arranged at the top of the secondary fuel tank 11. The connection 26 for the primary fuel line 12 is directed so that it matches the routing of the line. The connection 26 is positioned as high as possible on the secondary fuel tank 11 so that it exits above the surface of the fuel for as long as possible during the venting procedure. The connection 28 for the secondary fuel line 13 is positioned as low as possible and directed toward the fuel connection of the diaphragm carburetor 4. The internal volume of the secondary fuel tank 11 facilitates effective separation of air and a fast complementary venting. A suitable volume is about 18 milliliters. The secondary fuel tank 11 is made of the plastic material PVDF. It can also be made in other suitable plastic materials such as polyamide.

Figure 5:
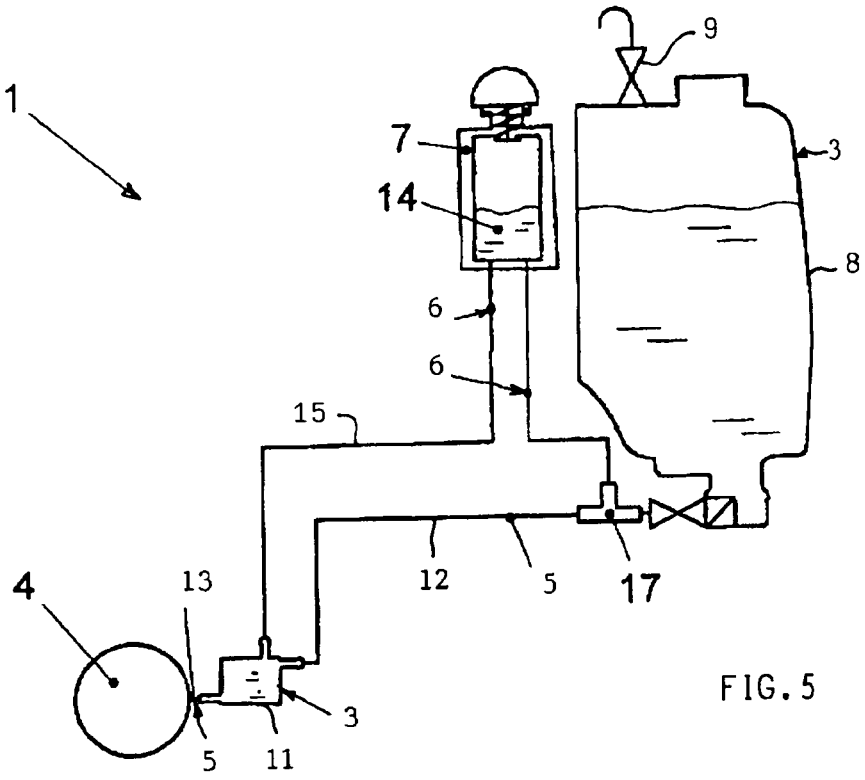
FIG. 5 is a schematic of a second embodiment of the fuel system of the invention; and, FIG. 6 is a schematic of a third embodiment of the fuel system of the invention.

FIG. 5 shows a second embodiment of the fuel system 1. The only difference compared to the first embodiment is that the venting valve 7 contains only one chamber 14 and that both the venting lines (15, 16) are connected thereto. This means that a somewhat longer time is needed to carry out a complementary venting of the fuel system 1. There is also some risk that small amounts of air will remain in the fuel system 1. The description for FIG. 5 otherwise corresponds to that of FIG. 2.

Figure 6:
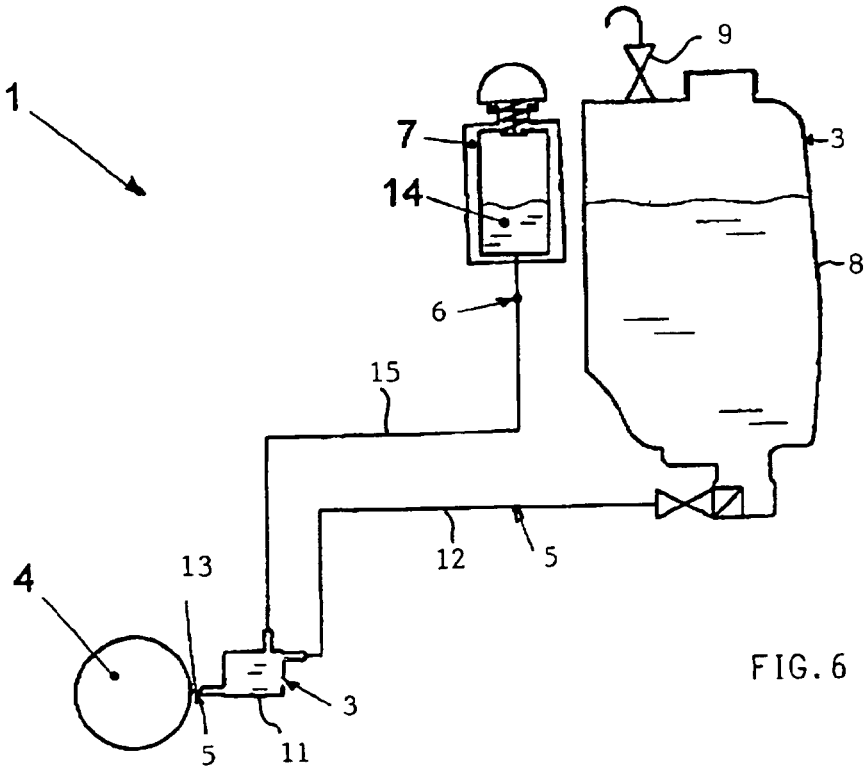

FIG. 6 shows a third embodiment of the fuel system 1. The only difference compared to the second embodiment is that the primary venting line 16 is omitted. The complementary venting therefore takes a longer time duration and is less effective than in the second embodiment. On the other hand, the third embodiment contains fewer components. The description for FIG. 6 otherwise corresponds to the description for FIGS. 2 and 5.

It is possible to simplify the fuel systems described above. The primary fuel tank 8 can be made so that it cannot be completely sealed, that is, by omitting the tank venting valve 9. Normal venting can be provided, for example, with a diaphragm in the filler cap that equalizes pressure in the fuel tank. The risks of fuel leakage increase; however, on the other hand, a possibility is given for fast and effective complementary venting of the fuel system 1.

It is understood that the foregoing description is that of the preferred embodiments of the invention and that various changes and modifications may be made thereto without departing from the spirit and scope of the invention as defined in the appended claims.

What is claimed is:

1. A fuel system for a vibratory rammer, the fuel system comprising:

a primary fuel tank for holding fuel for said fuel system;

a secondary fuel tank;

a primary fuel line for supplying fuel from said primary fuel tank to said secondary fuel tank;

a diaphragm carburetor;

a secondary fuel line for supplying fuel from said secondary fuel tank to said diaphragm carburetor;

a venting valve switchable between a first position wherein said venting valve is closed to the atmosphere and a second position wherein said venting valve is open to the atmosphere;

a venting line for venting air from said secondary fuel tank to the atmosphere via said venting valve;

said venting valve being actuated in said second position and non-actuated when in said first position; and, said venting valve including means for delaying the closing of said venting valve following actuation thereof.

2. The fuel system of claim 1, wherein said venting valve includes a chamber and said venting line is connected to said chamber.

3. The fuel system of claim 1, wherein said venting valve includes a filter.

4. A fuel system for a vibratory rammer, the fuel system comprising:

a primary fuel tank for holding fuel for said fuel system;

a secondary fuel tank;

primary fuel line for supplying fuel from said primary fuel tank to said secondary fuel tank;

a diaphragm carburetor;

a secondary fuel line for supplying fuel from said secondary fuel tank to said diaphragm carburetor;

a venting valve switchable between a first position wherein said venting valve is closed to the atmosphere and a second position wherein said venting valve is open to the atmosphere;

a venting line for venting air from said secondary fuel tank to the atmosphere via said venting valve;

said venting valve including a chamber and said venting line being connected to said chamber; and, said venting line being a secondary venting line and said system further comprising a primary venting line connecting said primary fuel line to said chamber for venting air from said primary fuel line to the atmosphere via said chamber.

5. The fuel system of claim 4, wherein said venting valve includes a filter.

6. A fuel system for a vibratory rammer, the fuel system comprising:

a primary fuel tank for holding fuel for said fuel system;

a secondary fuel tank;

a primary fuel line for supplying fuel from said primary fuel tank to said secondary fuel tank;

a diaphragm carburetor;

a secondary fuel line for supplying fuel from said secondary fuel tank to said diaphragm carburetor;

a venting valve switchable between a first position wherein said venting valve is closed to the atmosphere and a second position wherein said venting valve is open to the atmosphere;

a venting line for venting air from said secondary fuel tank to the atmosphere via said venting valve;

said venting line being a secondary venting line and said system further comprising a primary venting line;

said venting valve comprising two chambers;

said secondary venting line being connected to one of said chambers; and, said primary venting line being connected between said primary fuel line and the other one of said chambers for venting air from said primary fuel line to the atmosphere via said venting valve.

7. The fuel system of claim 6, wherein said venting valve is actuated in said second position and non-actuated when in said first position.

8. The fuel system of claim 6, wherein said venting valve includes a filter.

* * * * *